US005303619A

United States Patent [19]

Cole, Sr.

[11] Patent Number: 5,303,619

[45] Date of Patent: Apr. 19, 1994

[54] WRENCH ASSEMBLY FOR PROPANE TANKS AND GAS GRILLS

[76] Inventor: Wilbur C. Cole, Sr., 5300 W. Irlo Bronson Hwy. #422, Kissimmee, Fla. 34746

[21] Appl. No.: 910,210

[22] Filed: Jul. 9, 1992

[51] Int. Cl.[5] ..... B25B 13/58

[52] U.S. Cl. ..... 81/180.1; 81/462; 7/170

[58] Field of Search ..... 81/3.15, 180.1, 462, 81/125; 7/138, 170; 248/154, 505; 411/435, 427

[56] References Cited

U.S. PATENT DOCUMENTS

| | | | |
|---|---|---|---|
| 32,794 | 6/1900 | Harrison . | |
| 56,945 | 1/1921 | Piotrowski . | |
| 200,971 | 3/1878 | Berdan et al. | 81/180.1 |
| 313,153 | 12/1990 | Lockman | D8/21 |
| 643,098 | 2/1900 | Arthur | 81/180.1 |
| 1,099,079 | 6/1914 | Alden | 81/180.1 |
| 1,402,391 | 1/1922 | Baldus | 81/180.1 |
| 2,408,450 | 10/1946 | Schrader | 81/462 |
| 2,530,914 | 4/1947 | Simmons | 145/50.5 |
| 2,603,134 | 9/1948 | Burnam | 95/86 |
| 2,639,208 | 5/1948 | Obenchain | 312/100 |
| 3,870,209 | 3/1975 | Mazur | 224/5 V |
| 4,621,738 | 11/1986 | DeLucchi | 211/70.6 |
| 4,754,827 | 7/1988 | Hirabayashi | 180/68.5 |

*Primary Examiner*—James G. Smith
*Attorney, Agent, or Firm*—Hoffman Wasson & Gitler

[57] ABSTRACT

A wrench assembly for retaining a pair of propane tanks in spaced relationship, while providing a convenient storage structure for a wrench required for maintenance of the propane tanks. The assembly includes a threaded rod positioned between the propane tanks, and a bracket securely retains the tanks in position when a wrench having a threaded opening is screwed onto the threaded rod. The assembly overcomes the problems associated with the misuse of tools when the appropriate wrench is unavailable.

5 Claims, 4 Drawing Sheets

WRENCH ASSEMBLY FOR PROPANE TANKS AND GAS GRILLS

BACKGROUND OF THE INVENTION

The present invention relates to a wrench assembly for securing propane tanks, used with recreational vehicles and gas grills, to their appropriate support structures.

DESCRIPTION OF THE PRIOR ART

The prior art relating to assemblies for easily and efficiently mounting items that must be securely held in position is vast and encompasses a wide range of methods and apparatuses to achieve a variety of results. However, the prior art fails to disclose a wrench assembly useful in securing single, or multiple, propane tanks to their appropriate support structures, while also providing a structure to store the necessary wrench at a location adjacent to the propane tank assembly.

For example, U.S. Pat. Nos. 2,635,939 and 2,639,208, issued to Obenchain, disclose assemblies for securely positioning propane tanks on a trailer. Each assembly includes a cover member which is securely held in position above the tanks, but fail to disclose any structure useful in storing a wrench at a location near the propane tanks. In use, the lack of a readily available wrench encourages, and often forces, people to use any tool available to remove and attach the fitting necessary to completely attach the propane tank to the apparatus utilizing the propane. Consequently, the brass fittings used to attach the propane hose to the propane tank, and the propane regulator, are often deformed and rounded by the use of an inappropriate tool.

The prior art also discloses a variety of wrenches and tools, but fails to disclose a complete assembly allowing for the simple and efficient storage that the instant invention provides. U.S. Pat. No. 2,530,914, to Simons, discloses a screw eye wrench having a perpendicularly directed handle at its distal end. Shuriff (U.S. Design Pat. No. 227,651), Piotrowski (U.S. Design Pat. No. 56,945), Lockman (U.S. Design Pat. No. 313,153), and Harbison (U.S. Design Pat. No. 32,794) disclose wrench heads having closed configurations that require the wrench head to be positioned over the nut before they may be properly positioned for use. None of these wrenches disclose any structure that would facilitate simple storage of the wrench adjacent to the apparatus requiring the use of the wrench.

Assemblies used to hold an object in a secure position are also known in the prior art. For example, Mazur (U.S. Pat. No. 3,870,209) and Burnam (U.S. Pat. No. 2,603,134) disclose supports for securely positioning a camera. The supports utilize a horizontal base having a perpendicularly directed screw for use in mounting a camera to the base. U.S. Pat. No. 4,621,738, to DeLucchi, discloses a holder for wrench sockets, which includes vertically directed mounting studs for holding the sockets in position. Additionally, U.S. Pat. No. 4,754,827, issued to Hirabayashi, discloses a clamp rod utilized in securing an automotive battery in position, but disclose no structures useful for holding necessary tools near the battery.

The instant invention overcomes the deficiencies associated with the prior art devices discussed above by providing a wrench assembly that securely holds an apparatus in position and provides a structure for storing the necessary wrench at a location adjacent to the apparatus requiring the use of the wrench.

SUMMARY OF THE INVENTION

The instant invention relates to a wrench assembly for use in securely holding an apparatus in position, while also providing a storage structure for storing the necessary wrench adjacent to the apparatus. Specifically, the wrench assembly is primarily intended for use with propane tanks that are utilized in conjunction with recreational vehicles and gas grills.

The assembly first includes a wrench particularly adapted for use with a propane tank. The wrench includes a square open ended head and a closed end head adapted to fit onto the brass fittings of the propane tank and the associated components. The wrench further includes a pair of perpendicularly directed handle members located adjacent to the heads of the wrench and a threaded hole in the center of the wrench. The use of the handle members and the threaded hole will subsequently be explained.

Additionally, the assembly includes a bracket that is secured between a pair of propane tanks, or to a single propane tank. A threaded rod is then secured to the propane tank support and passes through a hole located in the center of the bracket.

The propane tanks are securely held in position when the threaded hole of the wrench is screwed onto the threaded rod and forces the bracket into secure engagement with the propane tanks. In this position, the wrench is in its storage position, and is readily available when the propane tank must be secured to, or detached from, the propane hose by unscrewing the brass fittings. The handles are therefore used to tighten the bracket, or to remove the wrench from the threaded rod and release the bracket.

DETAILED DESCRIPTION OF THE INVENTION

Figure 1:
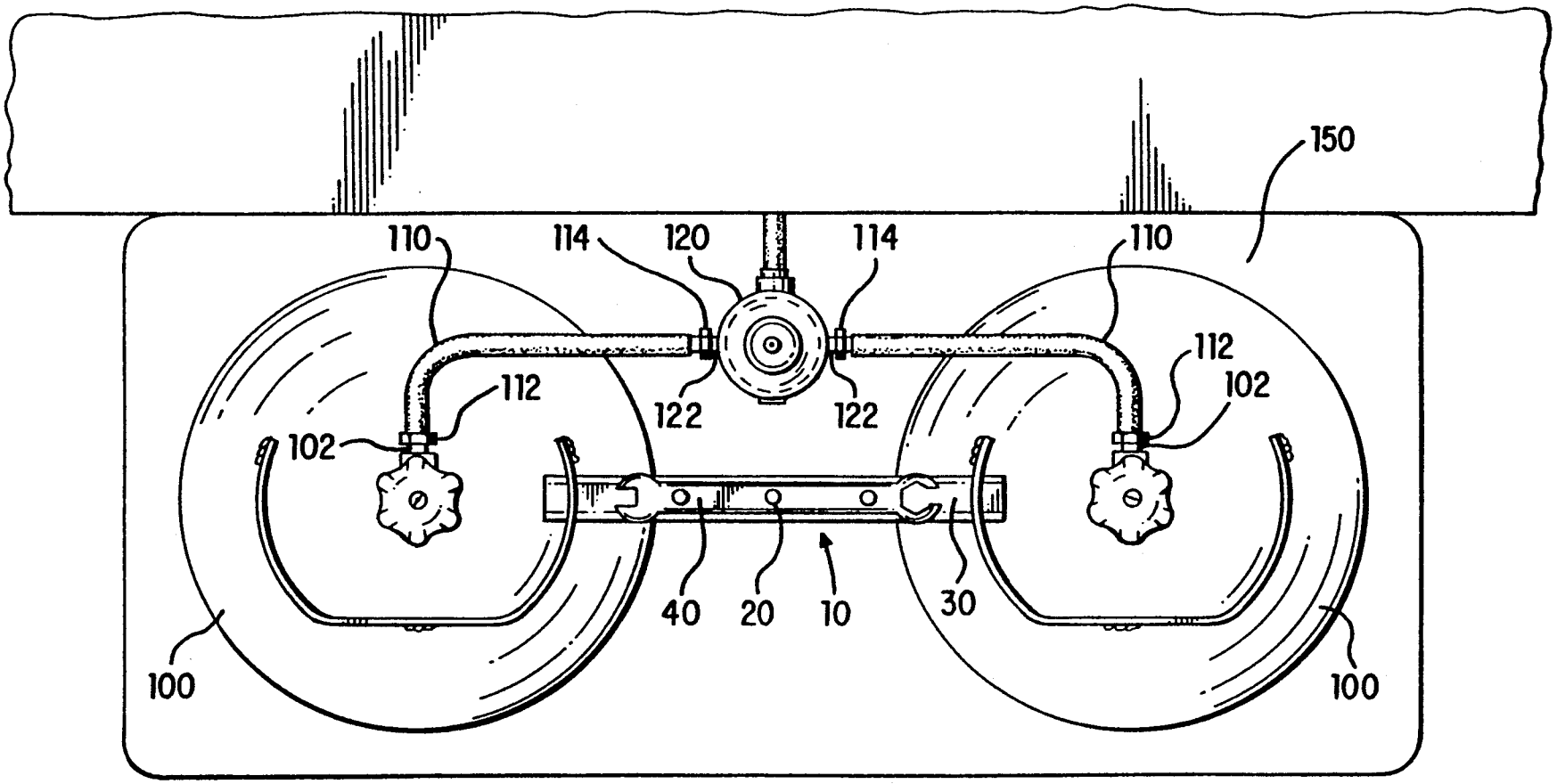
FIG. 1 shows a top view of the assembly in use.

FIG. 1 shows the wrench assembly 10 of the instant invention holding a pair of propane tanks 100 upon a propane tank support member 150. As the figure shows, when the propane tanks 100 are utilized with a recreational vehicle, propane hoses 110 attach the propane tanks 100 to a propane regulator 120. The propane regulator 120 appropriately controls the supply of propane to the internal structure of a recreational vehicle (not shown).

The propane hoses 110 are essential to the proper flow of propane, and first brass fittings 112 of the hoses 110 secure the hoses 110 to the valves 102 of the propane tanks 100. It should be noted that the threads of the first brass fittings 112 and the valve 102 are left handed. This creates many of the problems which necessitate the use of the appropriate wrench and the instant wrench assembly. Second brass fittings 114 of the hoses 110 secure the propane hoses 110 to the regulator valves 122 of propane regulator 120. Conventionally, first brass fittings 112, which are used in conjunction with the valves 102 of the propane tanks 100, have a $\frac{7}{8}$ inch hexagonal nut, and second brass fittings 114, which are used in conjunction with regulator 122 of the regulator 120, have 7/16 inch hexagonal nuts.

Figure 2:
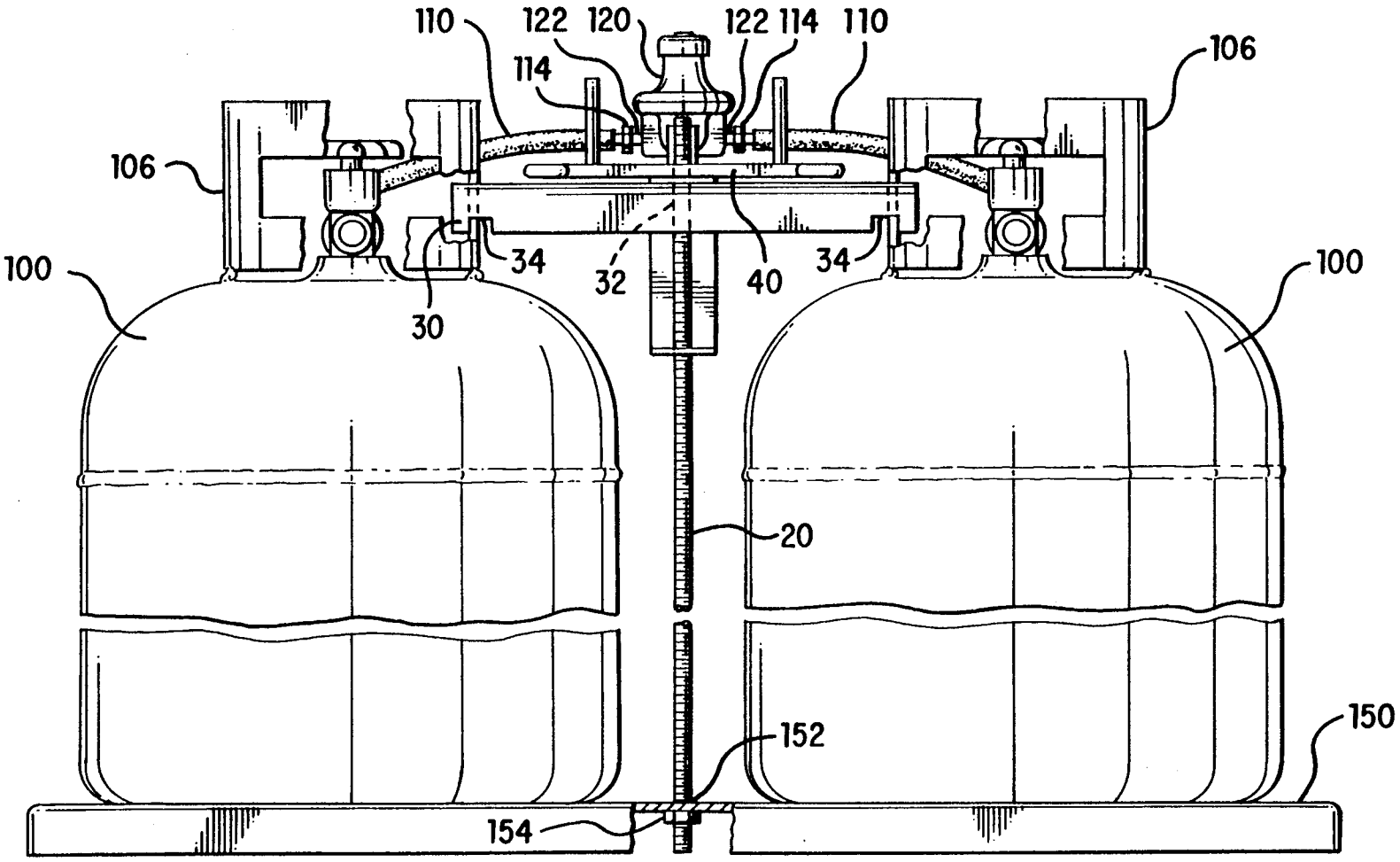
FIG. 2 shows a side view of the assembly.
Figure 3:
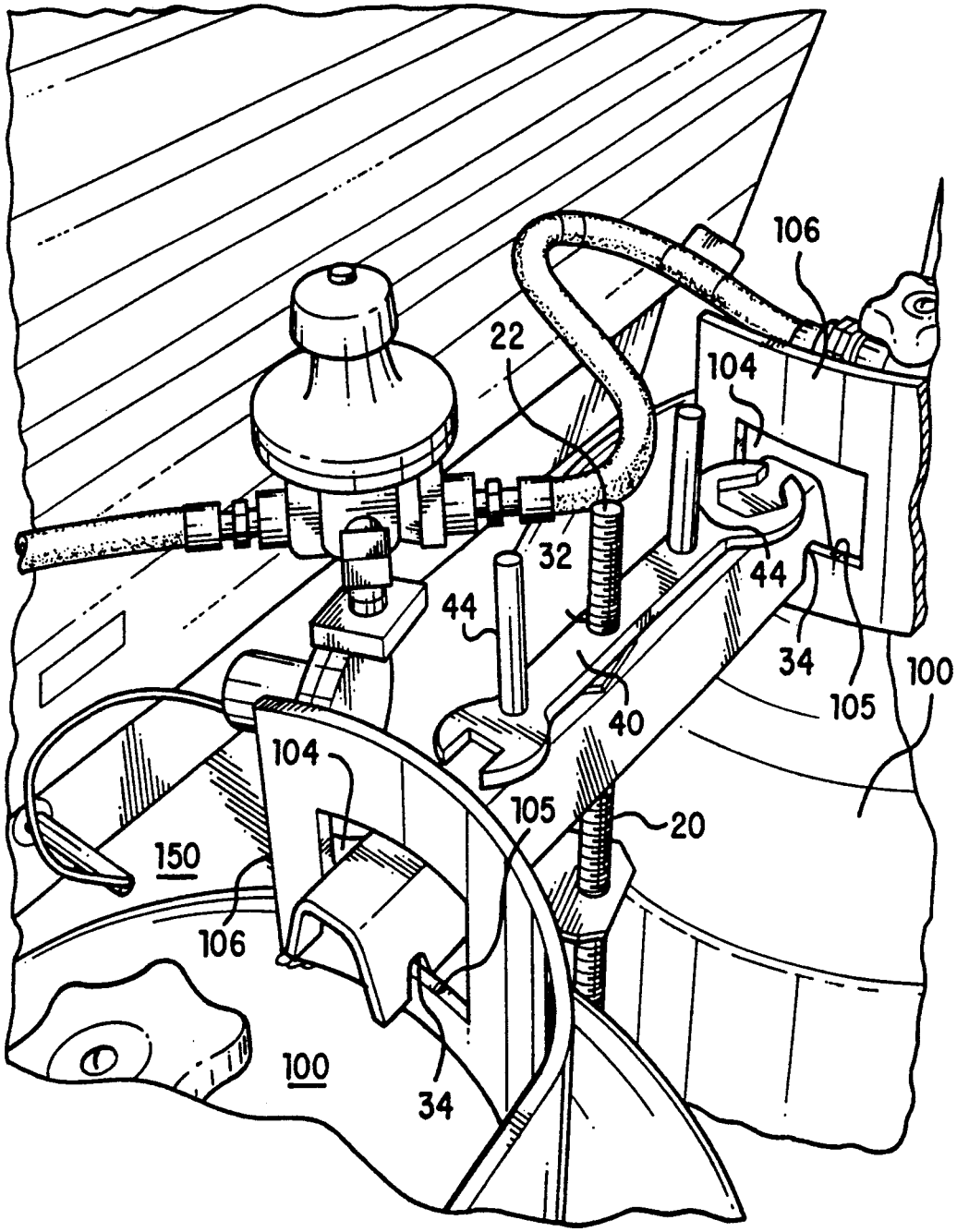
FIG. 3 shows a detailed plan view of the assembly.

As FIGS. 2 and 3 reveal, a threaded rod 20 is secured to support member 150 by conventional means (see FIG. 2). In the preferred embodiment, the threaded rod 20 passes through a hole 152 formed in the support member 150, and a nut 154, which is secured to the underside of the support member 150, holds the threaded rod 20 in position. The threaded rod 20 is positioned between the propane tanks 100. Bracket 30 is then positioned on the threaded rod 20 and between the two propane tanks 100. Specifically, the threaded rod 20 passes through the central hole 32 of the bracket 30, while the notched members 34 of the bracket 30 engage the handles 104 of the propane tanks 100. The handles 104 are formed in the protective shields 106 of the propane tanks 100 and the notched members 34 of the bracket 30 engage the lower edge 105 of the handles 104.

The wrench 40 includes a threaded opening 42 which is attached to the threaded rod 20 by screwing the wrench 40 onto the upper end 22 of the threaded rod 20. As the wrench 40 is screwed onto the threaded rod 20, pressure is applied to the bracket 30. The bracket 30 then acts to securely hold the propane tanks 100 on the support member 150. This is accomplished because the notched members 34 apply downward pressure to the lower edges 105 of handles 104. This pressure, when sufficiently applied, holds the propane tanks 100 between the notched members 34 of the bracket 30 and the support 150. The wrench 40 further includes a pair of handles 44 which facilitate the simple attachment and removal of the wrench 40 from the threaded rod 20. Then handles 44 are used to apply the appropriate pressure to the bracket 30 by gripping the handles 44 and screwing the wrench 40 onto the threaded rod 20 until sufficiently pressure is imparted to the bracket 30.

Figure 4:
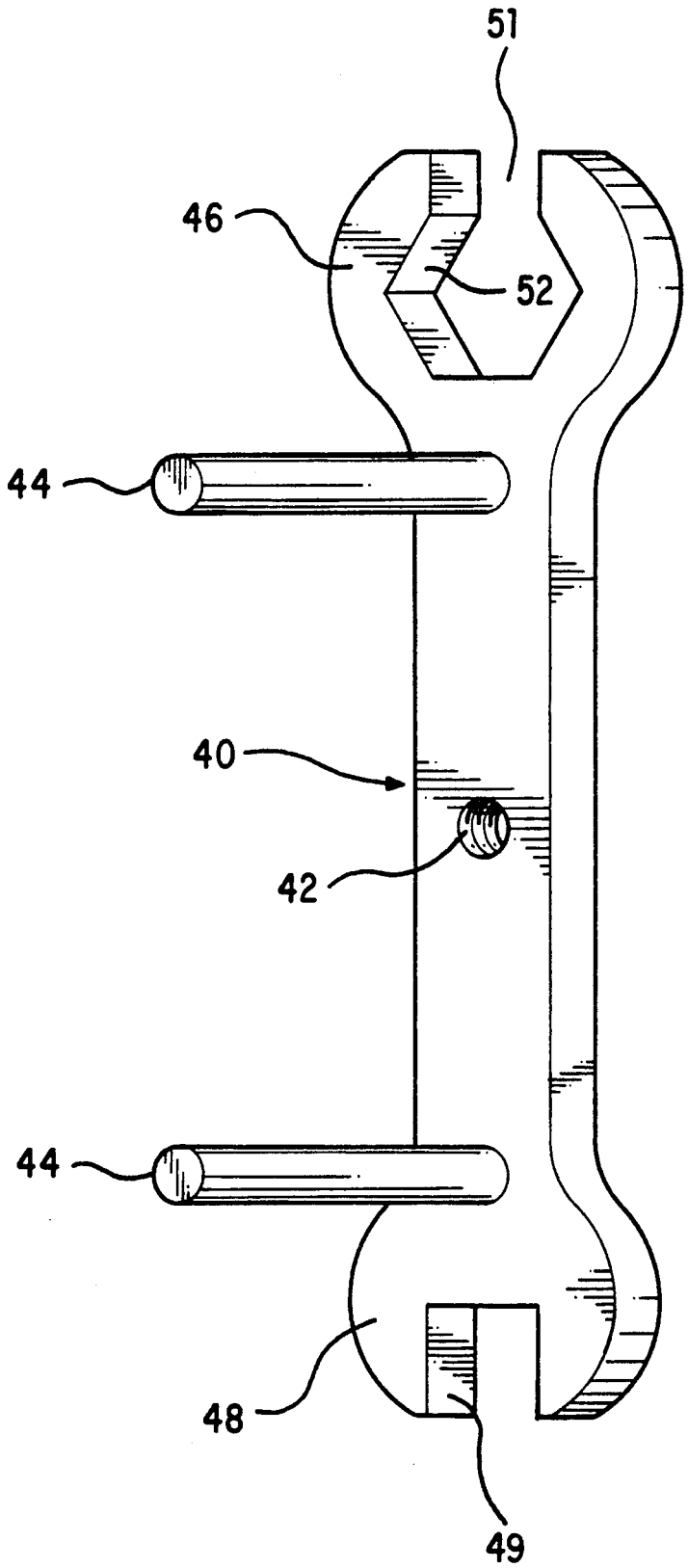
FIG. 4 shows a plan view of the wrench.

As previously stated, the instant wrench assembly 10 provides a convenient and efficient structure for storing the necessary wrench 40 at a location adjacent the propane tanks 100 requiring the necessary wrench 40. That is, once the wrench 40 is secured to the threaded rod 20 it is available when the first brass fittings 112 for the valves 102 of the propane tanks 200, and the second brass fittings 114 for the regulator valves 122, must be unscrewed to detach the propane hoses 110, or screwed on to attach the propane hoses 110. Consequently, the first head 46 and second head 48 of the wrench are manufactured specifically for the first brass fittings 112 and the second brass fittings 114, respectively. As a result, with reference to FIG. 4, the wrench 40 of the preferred embodiment includes a first head 46 having an opening 51 to fit around the propane hose 110 and a five sided surface 52 to engage the hexagonal nut of first brass fitting 112. Additionally, the second head 48 includes a square, three faced opening 49 to engage the second brass fitting 114.

The wrench assembly 10 described above provides a simple and efficient structure for securely holding a pair of propane tanks 100 on a support member 150 of a recreational vehicle, while also providing a convenient storage position for a wrench 40 required when the propane hoses 110 must be attached and detached. It should be noted that the embodiment described above is merely the preferred embodiment, and a variety of embodiments are possible within the scope of the instant invention. For example, the assembly could be modified for use with a gas grill. The assembly could also be modified for use with a single propane tank, or for use with brass fittings having a variety of shapes.

As a result, the present invention is not limited to the foregoing embodiments, but is capable of various modifications and alterations that fall within the scope and spirit of the appended claims.

I claim:

1. An assembly for retaining a pair of propane tanks and a wrench for opening same in operative relationship, said assembly comprising:

a) a pair of propane tanks, each tank having a lower end and an upper end, b) a fitting situated at the upper end of each tank, c) a support extending horizontally beneath said tanks, d) a bracket extending horizontally between the upper ends of said tanks to retain same in fixed position upon said support, e) a rod extending vertically upwardly from said support, f) said rod being threaded at its upper end, g) said bracket having an aperture in its central section to allow the upper end of said rod to pass therethrough, h) the invention being characterized by a wrench having a central body portion and different shaped openings at opposite ends thereof, i) said openings being adapted to match said fittings, j) said central body portion having a threaded opening defined therein, k) the threaded opening in said wrench being complementary to the threaded upper end of said rod, so that said wrench can be rotated about said rod until said wrench is adjusted downwardly against said bracket arm, thereby defining a storage position for said wrench in proximity to said propane tanks.

2. An assembly according to claim 1 wherein handles (44) are provided on said wrench to facilitate rotation thereof about said rod.

3. An assembly for retaining propane tanks and a wrench for opening same in operative relationship, said assembly comprising:

a) at least one propane tank, each tank having a lower end and an upper end, b) a fitting situated at the upper end of each tank, c) a support extending horizontally beneath each tank, d) a bracket extending horizontally across the upper end of each tank to retain same in fixed position upon said support, e) a rod extending vertically upward from said support, f) said rod being threaded at its upper end, g) said bracket having an aperture to allow the upper end of said rod to pass therethrough, h) the invention being characterized by a wrench having a central body portion and openings at opposite ends thereof, i) at least one of said openings being adapted to match said fitting, j) said central body having a threaded opening defined therein, k) the threaded opening in said wrench being complementary to the threaded upper end of said rod, so that said rod can be rotated about said rod until said wrench is adjusted against said bracket arm, thereby defining a storage position for said wrench in proximity to said propane tank.

4. An assembly according to claim 3 wherein handles (44) are provided on said wrench to facilitate rotation thereof about said rod.

5. An assembly according to claim 4 wherein said handles assume the form of rods projecting perpendicularly to said central body portion of said wrench.

* * * * *